United States Patent [19]

Lamb

[11] 4,208,849

[45] Jun. 24, 1980

[54] MULTIPLE GLAZED WINDOW AND METHOD

[76] Inventor: James V. Lamb, 917 Ashton St., Jacksonville, Fla. 32208

[21] Appl. No.: 876,897

[22] Filed: Feb. 13, 1978

[51] Int. Cl.[2] ..... E06B 7/12; E04B 1/66

[52] U.S. Cl. ..... 52/203; 52/741

[58] Field of Search ..... 52/171, 172, 202, 203, 52/303, 308, 741, 746

[56] References Cited

U.S. PATENT DOCUMENTS

| | | | |
|---|---|---|---|
| 2,964,809 | 12/1960 | Gwyn et al. | 52/172 |
| 3,971,178 | 7/1976 | Mazzoni et al. | 52/172 |
| 4,074,480 | 2/1978 | Burton | 52/172 |

FOREIGN PATENT DOCUMENTS

| | | | |
|---|---|---|---|
| 2311167 | 12/1976 | France | 52/172 |

*Primary Examiner*—James L. Ridgill, Jr.
*Attorney, Agent, or Firm*—Arthur G. Yeager

[57] ABSTRACT

A retroglazed glass pane of a window, wherein a spacing element, which is attached and sealed to the peripheral portion of a face of a new or second pane slightly smaller than the original light of the first or existing pane, is bonded to the confronting face of the first pane in a position such that a space remains between the sash elements and the edge of the second pane and the radially outward side of the spacing element, wherein such space is partially filled with a sealant material, which seals between the spacer and the first pane, and which such space is further filled with a resiliently compressible rod, typically of a rubberlike foam material, the rod being preferably characterized by low thermal conductivity; and a method of retroglazing wherein a desiccant is contained in such spacing element, protected against exposure prior to installation of the second pane, and wherein such rod is forced into the space between the edge of the second pane and the sash to force sealant material pre-deposited in such space to seal effectively between the spacing element and such confronting face of the first pane.

20 Claims, 33 Drawing Figures

MULTIPLE GLAZED WINDOW AND METHOD

BACKGROUND OF THE INVENTION

The double glazing of windows is well known for the purpose of heat insulation and to reduce solar heat loads, and it is known to add a tinted, reflective or the like pane to an existing clear glass pane. Various methods and means for accomplishing such retroglazing have been proposed, some of which have been commercially used, among which, for example, have been methods and means in accord with U.S. Pat. Nos. 3,971,178, 2,684,266 and 3,928,953. Reference may be had also to U.S. Pat. Nos. 3,226,903; and 3,105,274.

Taught by such patents are arrangements in which a hollow metal spacer member containing a desiccant is sealed to a peripheral portion of a surface of a new pane which is applied to an existing pane in a window sash. The spacer may comprise a slit therealong through which the desiccant is exposed to the dead air space between the two panes in the completed installation. U.S. Pat. No. 3,226,903 suggests that silica gel be inserted into the spacer and the spacer then be held in dry heated condition until the installation is to be completed. U.S. Pat. No. 3,928,953 relates to the sealing together of two new panes at the factory, with the desiccant open to the sealed space between the two new panes until they are separated in preparation for final installation. U.S. Pat. No. 3,971,178 suggests substitution of a strippable overlay of sheet material against the exposed side of the spacer in a prefabricated subassembly comprising only one pane of glass.

SUMMARY OF THE INVENTION

In accordance with the invention there is provided a method of adding a new pane of glass to an existing pane installed in a window sash by pre-attaching and sealing a spacer element containing a desiccant sealed therein to a new pane of glass, retaining such new pane in position with the spacer toward the existing pane while introducing a sealant compound into the space outwardly around the spacer element, and finally forcing a resilient rod into such space between the new pane and the surrounding sash. Prior to bringing the new pane into position, the seal which protects the desiccant in the spacer element from moisture is opened so that the desiccant will be exposed to the air space between the panes in the completed installation.

The invention further contemplates a retroglazed window sash characterized in that the spacer element is effectively sealed to the existing pane by sealant material urged into place so as to minimize voids by a preferably heat-insulating resilient rod wedged into and retained in place between the new pane and the sash, and which is further characterized by the provision of support means to take the weight of the new pane off of the adhesive which retains the spacer element against the old or existing pane.

According to the invention, a new pane of glass is pre-assembled to a spacing element, and such pre-assembly may be efficiently accomplished in the field at the job site, in a job shop typically located within easy trucking distance of a particular job, or on an assembly line in a manufacturing plant. For a job comprised entirely of uniformly sized window lights, it will normally be preferred to fabricate all of the pre-assemblies, if the lights are of a standard size, in a factory or in a job shop, but for a job wherein some of the lights are of odd sizes, it is an advantage that the same materials lend themselves to pre-assembly at the job site. Specifically, the spacing elements may be made adjustable over a small range or may be cut to appropriate lengths at the job site, while the final appearance of the installation will be uniform regardless of where the pre-assemblies are fabricated.

Among the objects of the invention are to provide improved methods, apparatus, materials and assemblies of elements for retroglazing, to result in a rapidly and easily installed second or new pane of glass spaced from an original pane in a glazed window, wherein the completed assembly is attractive in appearance and is characterized by improved thermal efficiency, particularly as to reduced thermal conductivity around the edges of the new pane.

Another object is to provide methods, apparatus, materials and elements for retroglazing of window panes of differing sizes and shapes and adapted to factory, job shop and field pre-assembly of elements for field installation.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

Figure 3:
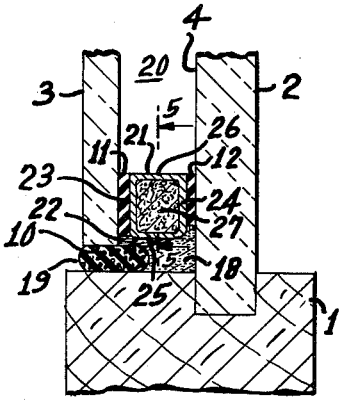
FIG. 3 is a similar sectional view taken along line 3—3 of FIG. 1.
Figure 4:
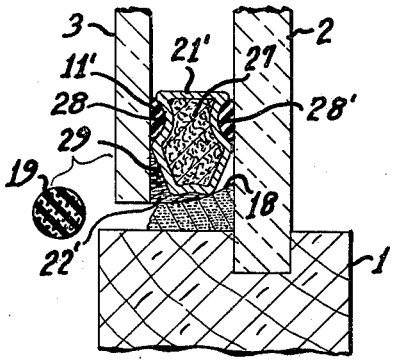
FIG. 4 is a sectional view similar to FIG. 3 but showing a modified spacing element and with compressible rod in position for insertion into place.
Figure 19:
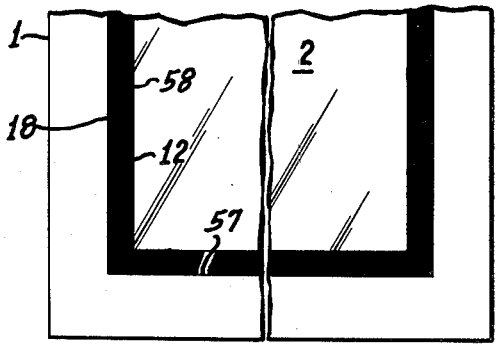
Figure 20:
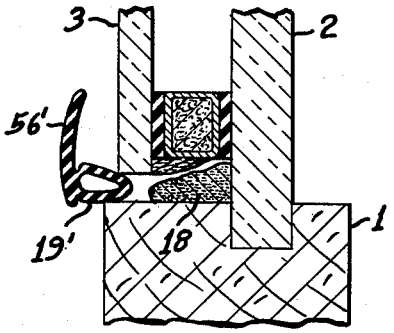
Figure 23:
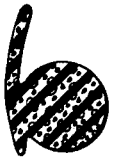
Figure 24:
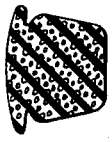
Figure 25:
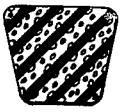
Figure 26:
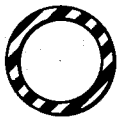
Figure 27:
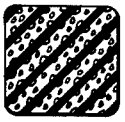
Figure 28:
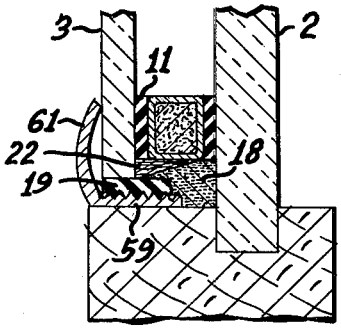
Figure 29:
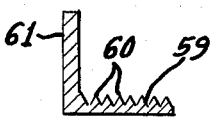
Figure 31:
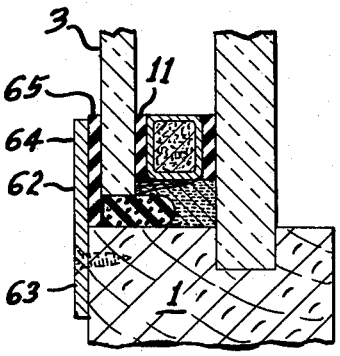
Figure 30:
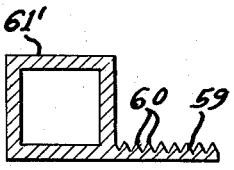
Figure 32:
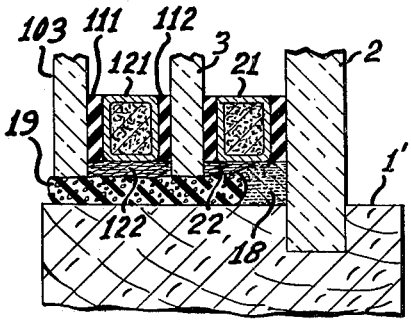

FIGS. 8, 9, 11, 14, 15, 17 and 18 are sectional views similar to FIGS. 2, 3 and 4, and FIGS. 10, 12, 13 and 16 are front inside elevational fragmental views, of a window and retroglazing elements and materials showing the steps of installation of a new or second pane in accord with my invention;

FIG. 19 is a back or outside elevational fragmental view showing a window retroglazed in accord with my invention;

FIG. 20 is a sectional view similar to FIG. 4 showing a combination trim and sealant pressing rod element being inserted into position;

FIGS. 21, 22, 23 and 24 are sectional views on a scale enlarged with respect to FIG. 20, of other forms of combination trim and sealant pressing rod elements;

FIGS. 25, 26 and 27 are sectional views, similar to FIGS. 21–24 of other forms of sealant pressing rods;

FIG. 28 is a sectional view similar to FIG. 3 of a completed installation comprising a trim strip;

FIGS. 29 and 30 are sectional views of alternative trim strips for the installation;

FIG. 31 is a sectional view similar to FIG. 28 comprising a further alternative trim strip; and FIG. 32 is a sectional view similar to FIG. 3 of a double retroglazed window.

DESCRIPTION OF THE PREFERRED EMBODIMENTS

Figure 1:
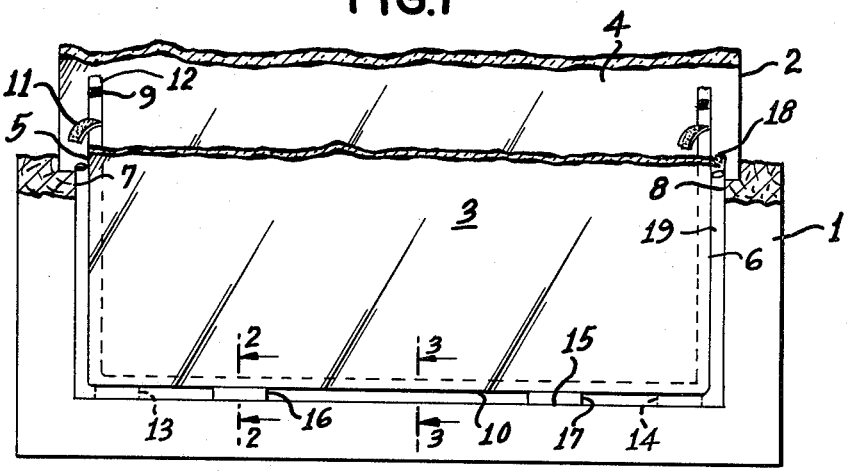
FIG. 1 is a front or inside elevational view of a retroglazed window partially broken away and in fragment in accord with my invention.

The general organization of the invention will be understood with reference to FIG. 1. The window sash 1, which is shown as a wood sash but which may be of other material, such as metal or plastic, or a combination of such materials, is glazed with an existing pane of glass 2. According to the invention, a second or new pane of glass 3 is positioned parallel to and spaced inwardly of the inner surface 4 of pane 2. The width dimension of the new pane between its side edges 5 and 6 is less, typically by about one-half inch, or between about one-quarter of an inch to one inch, than the internal width dimensions of the original light as defined by inner sash portions 7 and 8, and the height dimension of the new pane is similarly less than the height dimension of the original light.

Spacing means 9, preferably of metal, are disposed adjacent the side edges 5 and 6, and the lower edge 10 and upper edge (not shown), of the new pane, being adhered to the face of the pane which is disposed toward the original pane by suitable adhesive means, such as by a strip 11 of rubber-like tape of which the faces are self adhesive. According to the invention, the new pane 3, adhesive tape 11 and spacing means 9 are pre-assembled, and this pre-assembly is adhered to the face 4 of the original pane, such as by a self adhesive tape strip 12 similar to tape 11.

At the time of application of the sub-assembly, a pair of small temporary supporting blocks 13, 14 of hard rubber or other suitable material are positioned under the lower edge 10 of the new pane on respectively opposite sides of the center to rest on the lower sash member or rail 15 to carry the weight of the new pane. The blocks 13, 14 are represented by broken lines since they are later removed after two permanent supporting blocks 16 and 17, preferably of hard rubber or the like, are positioned on respective sides of the center of pane 3 between the lower edge of the pane and the lower sash.

As more particularly described hereinafter, a sealing compound bead 18 is positoned, such as by squeezing such compound through a nozzle, up against the inner surface 4 of the existing pane in the space radially outwardly around pane 3 and spacer 9 and inwardly of the sash 1 for the whole distance around the pane and spacer except for the lengths of such space taken up by the temporary blocks 13 and 14. Thereafter the permanent blocks 16 and 17 are pressed into place against the sealing compound, the temporary blocks 13 and 14 are removed, sealing compound is squeezed into the space exposed upon removal of the temporary blocks, and finally one length of flexible resilient rod 19 is urged or forced between the edge of the new pane and the sash into deforming contact with the bead of sealant along the lower edge 10 between the blocks 16 and 17, and a second length of such rod is so urged or forced into place along the space extending from one block to the adjacent corner, up along one side edge, across the top, down the other side edge and around the corner to the next block.

Figure 2:
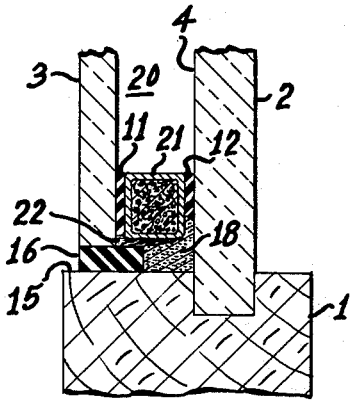
FIG. 2 is a sectional view on an enlarged scale taken along line 2—2 of FIG. 1.

In this manner the air space 20 as seen in FIGS. 2 and 3 has been hermetically sealed, and, as later explained, a desiccant will have been exposed and will remain exposed in this space. FIG. 2 shows existing pane 2 in place in sash 1 and the sub-assembly, comprising spacing element 21 adhered to new pane 3 by sealant strip 11 and sealed thereto by sealant 22, supported by permanent block 16. The sealant bead 18, being characterized by plasticity, has been forced into all of the interstices between the sash member 15 and the spacing element 21 and up against the adhesive strip 12, which acts as a dam to prevent the flow of sealant into the vision area thus to present a uniform appearance when viewed from the opposite surface. The sub-assembly is adhered to existing pane 2 by strip 12 and by sealant 18.

FIG. 3 is a section at a position along the bottom edge of pane 3 spaced from the support blocks and shows a completed installation, to which, however, trim may be added, if desired, as later described.

The spacer element 21 is in the form of an elongated tube, preferably of thin metal, which has opposite side walls 23 and 24, adhered respectively, to the new pane 3 and to the existing or original pane 2, and an outer wall 25 continuous with the side walls. The inner wall 26 completes a square cross-section spacer element in this embodiment of the invention, and the hollow interior of the spacer contains a desiccant 27, which may be molecular sieve or silica gel.

The adhesive shown as strip 11 is preferably moisture resistant and is not only adhesive but, preferably, acts as an hermetic sealant as well. Butyl, polysulfide, or polybutadiene, adhesive materials are among known adhesives which may be spread as a ribbon or bead on the spacer side wall 23, or on the marginal perimeter of the new pane, to adhere the spacer to the new pane and thereby to complete the sub-assembly. Alternatively, the adhesive may be in the form of sealant strip or tape material. As shown, additional sealing and structural strength is provided by applying sealant material 22 into any crevice which remains between the lower portion of the pane 3 and preferably over at least the adjacent portion of the bottom wall 25 of the spacer element, the sealant 22 having been squeezed and smoothed in place such as by a spatula or by a dispensing nozzle.

It is to be noted as shown in FIGS. 2 and 3 that the outer wall 25 of spacer element 21 is spaced radially inwardly of the extreme outer edge 10 of the new pane 3 thereby to expose a narrow peripheral area of the new pane outwardly of sealant and adhesive strip 11 to structural and sealant material 22, which, when so applied, bonds to the outer wall surface 25 and to such narrow peripheral margin of the pane.

The completed retroglazed window pane assembly further comprises adhesive dam 12 between spacer wall 24 and face 4 of the original window pane 2, the body of sealant 18 filling all interstices and crevices radially outwardly around adhesive strip or dam 12, up to and in sealing contact with the glass surface 4 which lies between the adhesive dam 12 and the sash 1, and along the surface portions of the sash adjacent pane 2 and of the spacer wall 25 and the previously applied sealant 22. This is accomplished by pressing the foam rubber or similar resilient plastic foam rod 19 into place against sealant 18 to cause it to ooze or flow. The rod 19 is shown as compressed into a generally ovaloid shape between the edge of pane 3 and the sash and in contact with the sealant 18.

It is preferred to employ materials for strips 11 and 12 which are moisture resistant, have long life, and which have amply sufficient bond strength, to the glass and to the space material, to support the new pane 3. The sealant 22 and sealant 18 should be of material which provide hermetic sealing between the surfaces with which they are in contact and would, of course, be water resistant. It is preferred that the adhesive strips or layers 11 and 12 be of materials which not only provide adherent strength but which also provide hermetic seals, and it is similarly preferred that the sealants at 22 and 18 provide additional support for the new pane and the spacer, but non-hardening or non-curing sealants have been found satisfactory. Appropriate sealants are polysulfide materials, or butyl-based compounds or polybutadiene.

FIG. 4 shows a new pane 3 and spacer in the process of being installed in a sash 1. The spacer element 21' is of a modified keystone shape providing shallow side grooves, such as groove 28, for receiving a bead of adhesive 11' bonding the spacer to the pane 3 to form a sub-assembly, the opposite groove similarly receiving a similar adhesive bead 28' which serves as a dam barrier for sealant 18, and which adheres the sub-assembly to the original pane 2. With this and similar shaped spacers, the adhesive dam 28' may be omitted as long as intimate contact of the spacer is maintained to the original pane 2 to prevent sealant 18 from flowing nonuniformly into the dead air space or vision area. Sealant 22' has been pre-applied to fill the crevice between the new pane 3 and the adjacent inclined wall portion 29 of the spacer element. The spacer element 21' is seen to contain desiccant 27. A resilient foam rubber rod 19 is shown in position for introduction into the space between the edge of pane 3 and the sash 1 against the sealant 18 and thus to force the plastically deformable sealant 18 into all of the remaining crevices and space between the spacer element, the pane 2 and the sash, the rod then to remain in its flattened shape in the space between the edge of pane 3 and the sash. The rod 19 when in final position, as shown in FIG. 3, will be held in place by being so compressed and, in addition, preferably by bonding to the sealant 18.

The foam rod has a diameter, before compression, greater than the clearance distance between the edge of the new pane and the sash element, while the perpendicular distance from the exposed face of the new or added pane to the existing pane is typically, about three times such clearance distance or about twice such diameter.

Figure 5A:
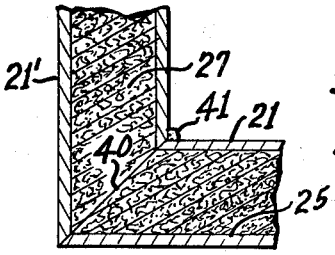
FIG. 5A is a sectional view similar to FIG. 5 showing a modified corner arrangement.
Figure 5:
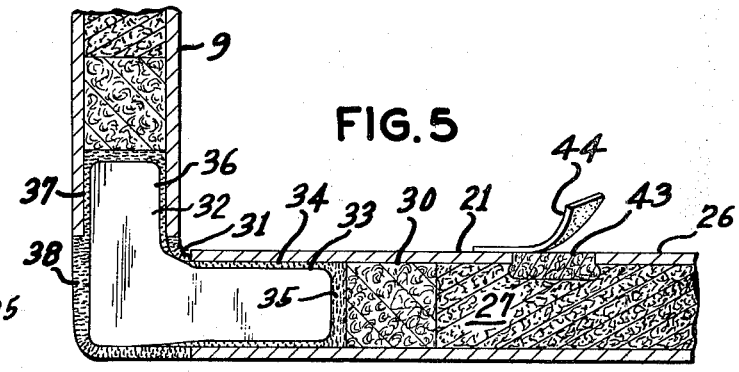
FIG. 5 is a sectional view taken along line 5—5 of FIG. 3 showing a corner arrangement of the spacing element.
Figure 8:
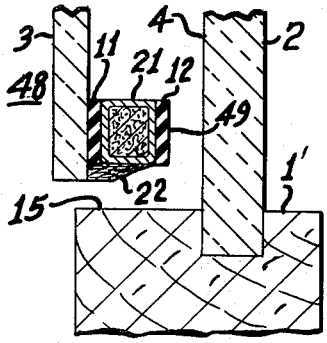

FIG. 5 shows a corner construction of the spacer means, wherein desiccant 27 is disposed in one hollow spacer element 21 and is retained by a wool, felt or the like plug 30 which is spaced from an end 31 of the spacer element 21. An elbow element 32 of solid metal or plastic comprises arm 33, which is proportioned to pass through the open end 31 of element 21 and into the portion 34 between plug 30 and end 31. A quantity of sealant 35, which may have been inserted into the end portion 34 before insertion of the arm 33 so as to be displaced by the arm, seals around the arm so that the arm and sealant completely fill the otherwise hollow portion 34. The second arm 36 of the elbow element, which is at right angles to arm 33, is similarly inserted and sealed in the similar end portion 37 of the next adjacent element of the spacing means 9. Additional sealant material 38 is smoothed into place around portions of the elbow element between the ends of the adjoining spacer elements at each corner to finish off the corner of the spacer means to conform to the external shape and dimensions of the spacer elements. Minor adjustments to the width and height of the spacer element may be accomplished by inserting the arms more or less deep in the hollow spacer element tubes.

Alternatively, it may be found more economical to form a closed corner by mitering at 45 degrees the ends of spacer elements or tubes, such as spacer element 21 or 21', and, as shown in FIG. 5A, adjoin such mitered ends and to solder, braze or weld along the meeting line 40, such as by solder 41. When the corners are so formed, the interior of the spacer means may be continuously hollow throughout, and this interior is completely or partially filled with desiccant 27. Alternatively to or additionally to such soldering of mitered corners, an elbow member may be employed, and the meeting line may be sealed by sealant material, if not soldered.

Each of the four corners of the rectangular spacing means 9 is completed by one or the other of the above explained arrangements.

Figure 6:
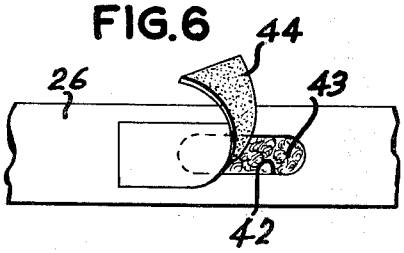
FIG. 6 is a top plan view of a portion of a spacing element or of a desiccant cartridge according to my invention.

Referring to FIGS. 5 and 6, at least some, and preferably all four, of the two horizontal and two vertical runs of the spacer means contain a quantity of desiccant which may be poured in through openings, such as opening 42, in the inner wall 26 of the spacer elements, this wall being that which is, in the completed installation, exposed to the air space 20 between the new and original panes 3 and 2. Each such opening is then plugged, to retain the desiccant, with a small vapor-pervious plug 43 of wool or the like, which may be pushed into place through the hole and, except in those instances in which the desiccant is poured into the spacer immediately before installation of the sub-assembly, a protective metal foil or other moisture-impervious adhesive tape strip 44 is applied to the wall 26 in covering relation to the hole 42 to seal the desiccant against moisture absorbance prior to installation of the new pane. The seal is broken by pealing tape 44 away and discarding it immediately before installing the sub-assembly.

Figure 7:
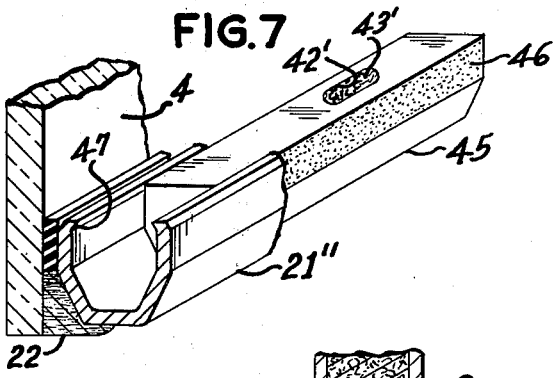
FIG. 7 is a perspective view, partially broken away and in section, showing a modified spacing element with a desiccant cartridge disposed therein.

FIG. 7 shows an alternative arrangement wherein the spacer element 21" is in the form of an open trough, generally U-shaped in cross-section, and provided with a desiccant-containing cartridge 45, the desiccant being exposed through an opening 42' plugged with a wool or the like plug 43'. The cartridge may be held in place by contact adhesive 46, or, preferably, by providing an inturned edge 47 of one or each of the side walls of the spacer element. The side walls may spring apart slightly to permit the cartridge to be snapped or clipped in place, the cartridge thereafter to be retained by the inturned edge or edges 47.

Figure 9:
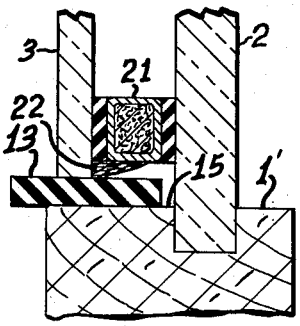
Figure 10:
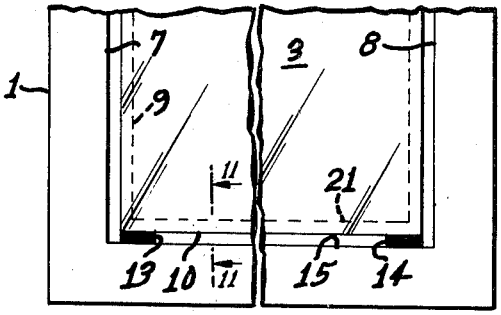

The several steps of installing a new pane and spacer means according to the invention comprise the cutting of a pane to be, typically, one-half inch less in height and in width than the dimensions of the existing light, or as much as about one inch less for large panes or as little as one-quarter inch for small panes, and the providing of a rectangular spacer element having outside dimensions equal to or, preferably, slightly less, by up to about one-quarter inch, than the new pane dimensions. The spacer element is adherred to the peripheral border portion of one face of the new pane by adhesive and sealed thereto, as above described, to form the sub-assembly as shown at 48 in FIG. 8. It may be appropriate to clamp or otherwise force the spacer 21 against the new pane 3 while adhesive sealant 11 and/or 22 sets or cures. Desiccant material will have been deposited in the spacer element 21 in the meantime, and a plug as previously described will have been placed in the spacer element opening. If the sub-assembly 48 is prepared and provided with desiccant at at a factory or plant the plugged opening will have been closed by impermeable adhesive tape strips, although if prepared and provided with desiccant in the field for installation without delay, such tape strip closures will not normally be necessary. If the spacer has been provided with an adhesive layer or tape strip 12 at a factory or plant, and if the surface 49 thereof, that is, the surface which will attach to the existing pane, has been protected by a Holland cloth or the like protective strip, such strip will now be peeled away, as will any cover strip 44 which has been used to seal the desiccant, and the sub-assembly will be brought adjacent the existing pane 2. As seen in FIGS. 9 and 10, temporary supporting blocks 13 and 14 are positioned on the lower sash member or rail 1' and used as guides to retain the sub-assembly in the correct vertical position, with the new pane centered between the vertical sash members 7 and 8, and the sub-assembly is manually advanced and pressed to engage the adhesive surface 49 firmly against the existing pane surface 4 thus to form a sealant barrier or dam. The elements are now in the positions according to FIG. 10 as viewed from the interior of the building.

Figure 11:
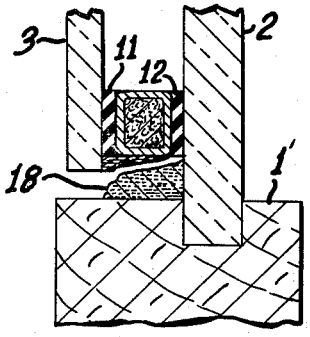
Figure 12:
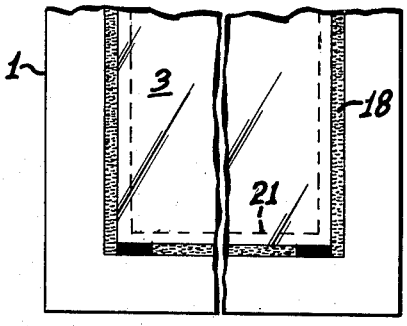

The next step understood in connection with FIGS. 10, 11 and 12 is to deposit a quantity of sealing compound 18 into the space between the outer edges of the new pane 3 and the sash, such as between edge 10 and lower sash member or rail 15, completely around the new pane and spacer, except where the temporary support blocks deny access. The compound is preferably supplied through a nozzle, such as from a caulking gun, and is preferably inserted so as to be deep within the space and in contact with the portion of the existing pane at and adjacent the sash. The sealing compound 18 is now positioned as shown in FIGS. 11 and 12.

Figure 13:
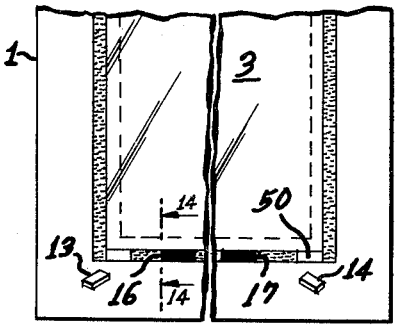
Figure 14:
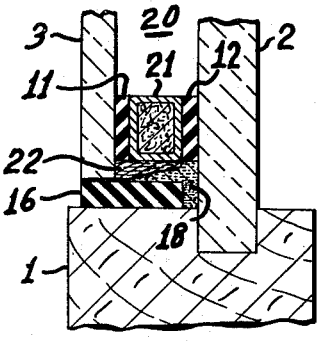

FIGS. 13 and 14 illustrate the next step which is to press permanent support blocks 16 and 17, of firm semi-hard rubber or the like, into position on opposite sides of the center of pane 3 against the sealing compound and into the position shown in FIG. 14. Pushing of these blocks into place will cause the sealant, which is plastic, that is, characterized by plasticity, to flow or ooze into all of the crevices and corners so as to displace the air pockets from and to fill completely all parts of the space inwardly of the block, and so as to be in unbroken contact with and to seal between the sash 15, the existing pane surface 4, the adhesive strip 12, any thereto exposed surfaces of spacer element 21 and of sealant 22, and to the surfaces of block 16 and block 17. With the permanent support blocks 16 and 17 in place, as seen in FIG. 13, the temporary blocks 13 and 14 are removed, leaving gaps or spaces such as gap 50, into which additional sealing compound is then introduced.

Figure 16:
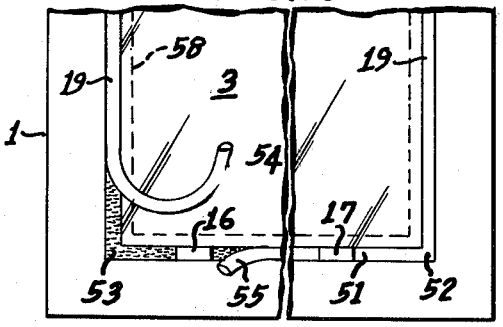

With compound now in place completely around the new pane 2, resilient rod 19 is next forced in between the peripheral edge 10 of the new pane and the sash members are indicated in FIGS. 4 and 16, starting, for example, next to block 17 with one end 51 of one length of rod 19 toward and around corner 52, working upwardly along one side of the new pane, across the top, downwardly along the other side around corner 53 and across the lower edge of pane 3 to block 16, the excess end portion 54 of the rod being then cut off so that this length terminates at block 16. A short length 55 of rod 19 is similarly forced into position between blocks 16 and 17 along the lower edge of pane 3.

Any excess of sealing compound 18 which is forced out by the blocks 16 and 17 while the blocks are being forced into position or which is forced out while rod 19 is being inserted into the space around the pane 3 is scraped off, such as by a spatula, and any remaining residue may be wiped away by a rag which may be wet with a suitable solvent.

A completed installation with the permanent blocks and the foam rod in place is shown in FIGS. 2, 3, 14 and 17.

Figure 18:
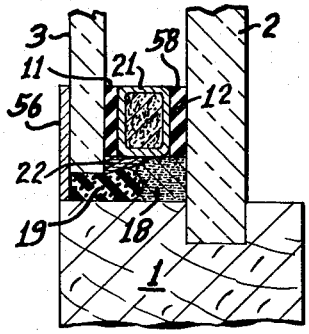

Further, however, it may be desired to add, as seen in FIG. 18, finishing trim in the form of a strip or band 56 to shield from view, from a position internally of the building, the adhesive band or layer 11, the sealant 22 and the rod 19. Such trim strip may be of metal, synthetic resin plastic material, or, if cost is a factor, simply an opaque adhesive strip.

While it is suggested above that excess sealant material 18 which may squeeze out as the rod 19 and blocks 16 and 17 are forced into place may be scraped off, it may be desired, particularly if the sealant material is adherant to the material of the trim strip 56, to force such trim against any such sealant material thereby to attach the trim strip, followed by the removal of any excess sealant which may be squeezed out beyond the edges of the trim strip. Alternatively, the strip 56 may be glued in place.

A complete installation as viewed from outside of the building will appear as in FIG. 19, wherein the sealant material 18 will be seen through the existing pane 2 immediately inwardly of the boundaries 57 of the original light, and with the adhesive or adhesive band 12 similarly visible immediately inwardly of the sealant material 18. The new light is defined between the inner edges 58 of the adhesive strip 12.

Figure 15:
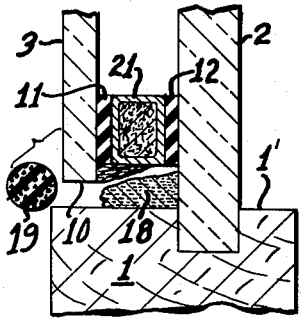

FIG. 20, which is similar to FIG. 15, discloses a resilient rubber, polystyrene, vinyl or the like element comprising an integral hollow rod portion 19' and trim portion 56'. When the rod portion 19' is forced into position as explained for rod 19, the sealant material 18 is similarly forced to fill the voids, and the trim portion 56' is retained in position to shield the peripheral border of the new pane 3 in substantially the same manner as for trim strip 56.

Figure 21:
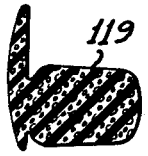
Figure 22:
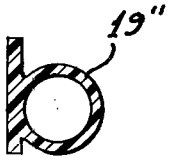

FIG. 21 shows a combination rod and trim element similar to that of FIG. 20 but which comprises a rod portion 119 which is of foam rubber or the like and which, accordingly, may be solid rather than hollow. FIGS. 22, 23 and 24 show other configurations of combination unitary rod and trim elements, the forms of FIGS. 23 and 24 being particularly adapted to be of foam rubber, while the form of FIG. 22 may be of resilient solid rubber or the like in that the rod portion 19" thereof is hollow.

Other shapes of members which may be substituted for rod 19 are shown in FIGS. 25, 26 and 27. The shapes of FIGS. 25 and 27 may be of foam rubber or the like, or of soft and readily compressible rubber or polystyrene or the like resilient material, while the shape of FIG. 26 is of resilient but somewhat less soft rubber or the like in view of being hollow.

Figure 17:
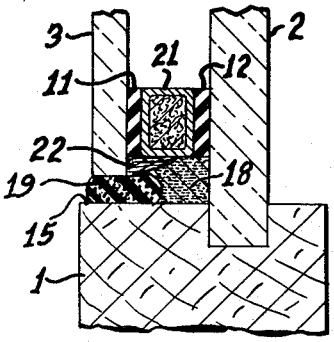

FIGS. 28, 29 and 30 disclose trim elements, which may be of extruded metal, or of other rigid material, and each of which includes a rigid lip 59 adapted to be forced between the rod 19 and the sash of an installation otherwise completed according to FIG. 17, or completed with a rod element in accord with FIGS. 25, 26 or 27. The longitudinal ridges or elongated teeth 60 of the lip engage upwardly into the rubber rod 19 to retain the element in place with its trim strip portion 61 in position to shield from interior view the rod 19, the sealant material 22 and the adhesive or adhesive strip 11. The trim strip portion 61 may be flat as seen in FIG. 29 or slightly curved as seen in FIG. 28. The trim strip portion 61' of the extension of FIG. 30 is square in cross-section, and may be desirably employed in those instances in which the sash extends inwardly beyond the plane of the inner face of pane 3 by a substantial distance.

According to FIG. 31 a trim strip 62 comprises a lower panel portion 63 which is screwed to sash 1 and an upper panel portion 64 which overlies the peripheral margin portion of pane 3 and which not only shields adhesive 11 from view but which also affords substantial additional support and security for pane 3. In this, as in other cases, it is desirable to dispose a gasket 65 between metal trim and any glass with which such trim would otherwise be in contact, although such gasket will not, ordinarily, be needed for plastic trim material.

FIG. 32 shows a double retroglazed window wherein a first new or added pane 3 is held in place adjacent existing pane 2 in the manner previously described, with spacing element 21 interposed, but in this case a second new or added pane 103 is held in position spaced from pane 3, with spacer element 121 interposed and sealed to the confronting faces of panes 103 and 3 by adhesive tape strips 111 and 112, respectively, which correspond to strips 11 and 12, and structurally secured by sealant material positioned as shown at 122 and otherwise corresponding to material 22. The foam rubber rod 19 is seen in FIG. 32 appropriately proportioned to squeeze the sealing compound 18 as before into the space defined between spacer 21, pane 2 and sash member 1.

It will be apparent that sub-assemblies of a new pane adhered and sealed to a spacer element as disclosed are adapted for volume manufacture in standard sizes or for large orders. Such manufactured sub-assemblies may include self adhesive strip 12 of which the face adapted to adhere to the existing pane of a window is covered by a pealable paper or the like tape to protect the adhesive, or no such adhesive strip may be applied at the factory but an adhesive bead may be applied to the spacer element in the field at the time of installation. Similarly, such manufactured sub-assemblies may be provided with desiccant sealed in the spacer element by a foil or the like tab 44, or similarly sealed cartridges 45 may be supplied either in place in the spacer element or separately for gluing or clipping in to the spacer elements in the field. Alternatively the desiccant may be inserted into the spacer element, or into a cartridge, in the field.

Where numbers of different sizes of window for a particularly job are to be fitted, the sub-assemblies are readily adapted to be fabricated at a job shop, or they may be completely assembled in the field at the job site, particularly if the job is small or if there are many different size window panes to be fitted.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. The method of adding a second pane of glass to an existing glass pane in a glazed sash, such second pane of glass having external dimensions less than the internal dimensions of the interior sash elements bounding the light of such existing pane, comprising the steps of sealingly bonding a spacing element to one face of said second pane, said element being disposed along a peripheral portion of said face immediately adjacent the edge of said face, bringing said second pane and spacing element into juxtaposition with the inner surface of such existing pane and with the edge of said second pane spaced inwardly from said sash elements, introducing sealant material into the space which is defined outwardly of said spacing element and inwardly of said sash elements and positioning such material in contact with that inner surface portion of said existing pane which lies between said spacing element and said sash elements, and thereafter causing said sealant to flow into intimate contact with and to seal between said spacing element and said surface portion of said existing pane by introducing a flexible resilient rod having an unstressed diameter greater than the distance between said edge of said second pane and said sash elements outwardly around said second pane and inwardly of said sash elements and forceably urging said rod into deforming contact with said sealant material in said space defined outwardly of said spacer element and inwardly of said sash elements.

2. The method according to claim 1, comprising the further step of, upon bringing said second pane and spacing element into such juxtaposition and before such introduction of sealant material, adhesively bonding said spacing element to said inner surface of such existing pane.

3. The combination according to claim 1 wherein said rod constitutes a portion of a unitary member which includes a flange portion laterally offset from said rod portion and adapted and arranged to engage against a peripheral portion of the other face of said second pane when the rod portion is so forced into such deforming contact.

4. The combination according to claim 1 wherein said rod is a hollow tube of resilient material.

5. The combination according to claim 1 wherein said rod is of rubber-like foam material.

6. The method of adding a second pane of glass to an existing glass pane in a glazed sash, such second pane having external dimensions less than the internal dimensions of the sash elements bounding the light of such existing pane, comprising the steps of hermetically sealingly bonding one of the side portions of a hollow spacer element, which said spacer element has a radially outwardly facing portion, an inwardly facing portion having an aperture therethrough and opposite side portions connecting said inwardly and outwardly facing portions, to the marginal portions of a major face of said second pane, depositing a desiccant in said spacer element, applying to said inwardly facing portion a temporary seal for said aperture, applying adhesive to the other said side portion, breaking said temporary seal and without delay thereafter centering said second pane within said sash with said spacer element oriented toward said existing pane and pressing said second pane toward said existing pane to engage said adhesive on said other side portion with said existing pane, supplying an at least partially uncured sealant material into the space between said sash elements and said outwardly facing portion of said spacer element, and introducing and forcing an elongated compressible resilient rod member having an unstressed diameter greater than the distance between the peripheral edges of said second pane and said sash elements into that second space which is defined inwardly by such peripheral edges and outwardly by said sash elements and into deforming contact with such sealant material in said space between said sash and said outwardly facing portion of said spacer element.

7. The method according to claim 6 and, after supplying said sealant material into such space and before such introduction of such rod member, positioning at least one support block between the lower edge of said second pane and the underlying sash rail and into deforming contact with said sealant material in said second space.

8. The method according to claim 6 and, before centering said second pane within said sash, placing supporting block means on the lower rail of said sash and engaging the lower edge of said second pane thereon while so centering and pressing said second pane.

9. The method according to claim 8, and removing said supporting block means after said second pane has been so positioned, and supplying additional such sealant material into the space from which said supporting block means has been removed prior to such forcing of such rod member.

10. A double glazed window light comprising a first pane fixed in a sash, said sash comprising a rail at the bottom of said pane which extends away from one surface of said first pane and comprising side and upper sash portions along the sides and across the top of said pane extending away from said one surface, a second pane disposed parallel to and spacedly adjacent said one surface of said first pane, said second pane being bounded by outer peripheral edges and having a first face disposed toward said one surface of said first pane and said first face of said second pane having a marginal edge portion therearound disposed opposite a portion of said one surface of said first pane inwardly adjacent to said rail and said sash portions, a spacer element extending and sealed along said marginal edge portion of said first face of said second pane, sealing material disposed along and sealed to the radially outward side of said spacer element and in sealing engagement with said one surface of said first pane, and a resilient rod dispos peripherally around said outer edges of said second pane and compressed between said outer edges and said rail and sash portions and in sealant-forcing engagement with said sealant material along said rail and side and upper sash portions.

11. The combination according to claim 10 wherein said rod is a hollow tube of resilient material.

12. The combination according to claim 10 wherein said rod is of rubber-like foam material.

13. The combination according to claim 10 wherein said rod includes a body portion and an integral trim strip portion attached along one side of said body portion, said body portion being so disposed in sealant-forcing engagement and said trim strip portion being disposed along said sash portions and overlying said marginal edge portion.

14. The combination according to claim 10 wherein said spacer element is adhered to said first face of said second pane by a strip of double faced self-adhesive tape.

15. The combination according to claim 10 wherein said spacer element is adhered to said one surface of said first pane radially inwardly of said sealing material.

16. The combination according to claim 10 wherein said second pane has a second opposite face, wherein a second spacer element extends and is sealed along said marginal edge portion to said second face, and wherein a third pane is sealed to said second spacer element in spaced confronting position with respect to said second face.

17. The combination according to claim 10 wherein at least a portion of said spacer element is generally trough shaped with such trough oriented to be open radially inwardly of said element and wherein a desiccant-containing cartridge is disposed in said trough.

18. The combination according to claim 17 wherein said cartridge is clipped in place in said trough.

19. The combination according to claim 17 wherein said cartridge is glued in place in said trough.

20. A double glazed window light comprising a first pane fixed in a sash, said sash comprising a rail at the bottom of said pane which extends away from one surface of said first pane and comprising side and upper sash portions along the sides and across the top of said pane, a second pane disposed parallel to and spacedly adjacent said one surface of said first pane, said second pane having a first face disposed toward said one surface of said first pane and said first face of said second pane having a marginal edge portion therearound disposed opposite a portion of said one surface of said first pane inwardly adjacent to said rail and said sash portions, a spacer element extending and sealed along said marginal edge portion to said first face of said second pane, sealing material disposed along and sealed to the radially outward side of said spacer element and in sealing engagement with said one surface of said first pane, a weight-supporting block on said rail, the lower edge of said second pane being engaged on said block, said block carrying the weight of said second pane on said rail and being in sealant-forcing engagement against said sealant material, and a resilient rod disposed in sealant-forcing engagement with said sealant material at least along said side and upper sash portions.

* * * * *